US007708346B2

(12) United States Patent
White et al.

(10) Patent No.: US 7,708,346 B2
(45) Date of Patent: May 4, 2010

(54) RECLINING BACK MECHANISM FOR A SEATING UNIT

(75) Inventors: Nikki White, Pontotoc, MS (US); Robert Dean Donovan, Mooreville, MS (US)

(73) Assignee: L&P Property Management Company, South Gate, CA (US)

( * ) Notice: Subject to any disclaimer, the term of this patent is extended or adjusted under 35 U.S.C. 154(b) by 429 days.

(21) Appl. No.: 11/549,161

(22) Filed: Oct. 13, 2006

(65) Prior Publication Data

US 2007/0278837 A1 Dec. 6, 2007

(51) Int. Cl.
*B60N 2/22* (2006.01)
*B60N 2/02* (2006.01)

(52) U.S. Cl. ..... 297/362.13; 297/362.12

(58) Field of Classification Search ..... 297/85 C, 297/85 L, 362.12–362.14
See application file for complete search history.

(56) References Cited

U.S. PATENT DOCUMENTS 2,018,828 A * 10/1935 Bell ..... 297/362.14
2,522,246 A * 9/1950 Armstrong ..... 297/318
2,579,305 A * 12/1951 Cushman ..... 297/362.14
4,004,836 A 1/1977 Kristensson
4,813,743 A 3/1989 Mizelle
4,877,291 A * 10/1989 Taylor ..... 297/300.3
5,007,679 A * 4/1991 Mizelle ..... 297/374
5,069,496 A 12/1991 Kunh et al.
6,019,429 A * 2/2000 Tedesco ..... 297/328
6,032,976 A * 3/2000 Dickie et al. ..... 280/650
6,149,236 A 11/2000 Brauning
6,913,316 B2 7/2005 Kinoshita et al.

* cited by examiner

*Primary Examiner*—David Dunn
*Assistant Examiner*—Tania Abraham
(74) *Attorney, Agent, or Firm*—Shook Hardy & Bacon, LLP

(57) ABSTRACT

A seating unit has a base pivotably coupled to a back by a reclining mechanism, which has a pair of arms pivotably coupled to the base side members. The arms are coupled to a rearward transverse member that swings forward and compresses a cylinder actuator as the user reclines the back. The opposed end of the actuator is coupled to a forward transverse member, which is in turn coupled between the base side members. The actuator has a release valve that is operated by pulling a manual lever of a release mechanism. The release mechanism frees the cylinder actuator from a rigid position thereby allowing the user to force the back rearward or allowing the predisposed extension force of the cylinder to return the reclining back to the fully upright position. Discontinuing the release mechanism will cause the actuator to arrest the back in a reclined position.

17 Claims, 6 Drawing Sheets

RECLINING BACK MECHANISM FOR A SEATING UNIT

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The invention relates to furniture such as a chair or sofa, such furniture pieces being referred to herein generally as seating units, and more particularly, to an improved mechanism for controlling the inclination angle of the back rest to the seat cushion.

Modern recliners exist that allow a user to recline the chair back relative to the seat. These existing recliners use mechanisms to control the inclination angle of the back. These mechanisms are housed internal to the seating and or back unit such that the mechanisms are hidden from view. However, these mechanisms are relatively complex and to some extent impose constraints on the furniture manufacture and transportation. Specifically, some of these mechanisms prohibit the disassembly of the back from the base frame, which holds the seat cushion, because the mechanisms extend into, and form a part of, the back. Additionally, these existing recliner mechanisms require a particular cross-beam configuration that is sized for each specific width of seating unit. This precludes manufacturing and assembling uniform components when producing a variety of sizes and styles of seating units.

The present invention pertains to a reclining back mechanism separable from the back rest. Significantly, the mechanism of the invention is constructed so that it is located within the stationary base area of the seating unit, thus enabling disassembly of the back rest from the base frame to facilitate, among other things, shipping and manufacture. Further, the present invention provides for a system of multiple lengths of interchangeable cross beams that allows for the manufacture of a variety of sizes, widths, and styles of recliners.

BRIEF SUMMARY OF THE INVENTION

A reclining back mechanism for a seating unit, where the seating unit has a stationary base and a reclining back. The stationary base has a pair of opposed side members, and the reclining back has a pair of opposed side frames. The reclining back mechanism has a pair of arms, a rearward transverse member, a forward transverse member, and an actuator. The arms are pivotably coupled to each of the opposed side members. Additionally, the arms have one end coupled to each respective opposed side frame, and another downwardly extending end. The coupling of the arms and side frames constitutes an attachment between the reclining back and the stationary base. This attachment is made by a mating component such that the mating component facilitates rapid assembly and disassembly of the reclining back from the stationary base. The rearward transverse member is made from generally rigid material and has opposed ends extending generally between the opposed side members. These opposed ends are coupled to the downwardly extending end of each respective arm. The downwardly extending end has multiple mounting holes that provide for selection of mounting positions between the arm and rearward transverse member. The forward transverse member is made from generally rigid material and has opposed ends extending generally between the opposed side members. These opposed ends are coupled to each respective opposed side member with a mounting bracket. The mounting brackets have multiple mounting holes that provide for a selection of mounting positions between the opposed side members and the forward transverse member. These multiple mounting hole locations are consistent in number and spacing with the multiple mounting hole locations of the downwardly extending ends of the arms. This configuration allows for the assembly of multiple stationary base widths while fixing the length of the transverse members.

The actuator is pivotably coupled on one end to the rearward transverse member, on the other end to the forward transverse member. Typically, the actuator is a gas cylinder with a release valve that is actuated by a release mechanism. The release mechanism includes a manual lever, a cable, and a release valve lever. When the release mechanism is not activated, the gas cylinder is rigid and holds the reclining back mechanism in a fixed orientation. A user of the seating unit may pull the manual lever of the release mechanism to adjust the reclining back to a reclined position. Pulling the manual lever rotates the lever and operates the cable, which in turn rotates the release valve lever. As the release valve lever rotates, it contacts the release valve, releasing the actuator and allowing movement of the reclining back mechanism. As a user exerts rearward force on the reclining back, the side frames cause the arms to pivot. This pivoting motion is carried through the downwardly extending ends of arms and swings the rearward transverse member forward toward the forward transverse member, compressing the actuator. As the user discontinues pulling of the manual lever, the actuator will arrest the position of the reclining back at a fixed position. A user of the seating unit may pull the manual lever of the release mechanism to return the reclining back to an upright position. Activating the release valve releases the actuator and allows its predisposed extension force to return the reclining back to the fully upright position.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
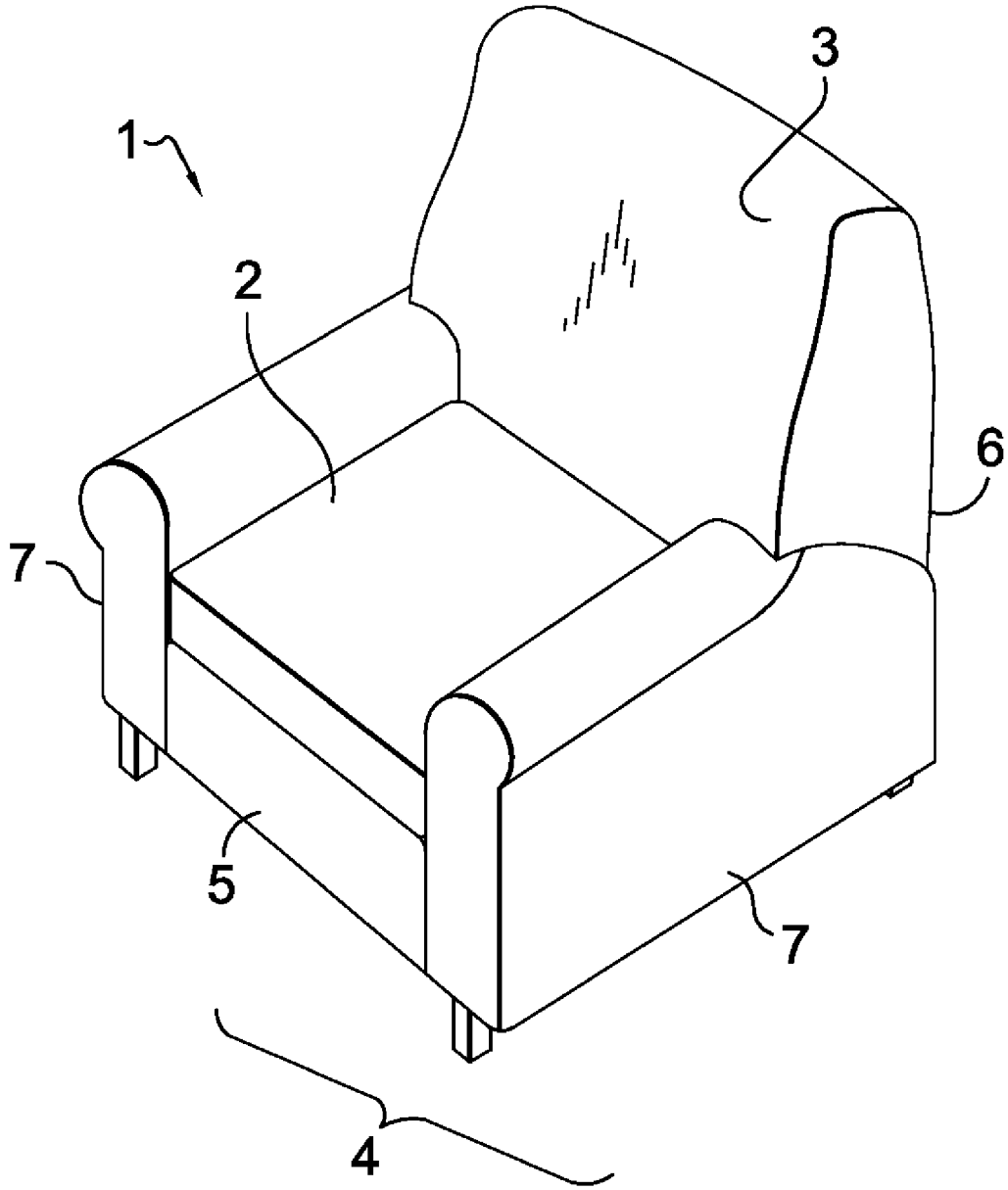
FIG. 1 is a diagrammatic perspective view of a seating unit.

Referring to FIG. 1, it can be seen that the typical reclining chair 1 has a seat cushion 2, a reclining back 3, and a base section 4. Base section 4 has a front 5, a back 6, and two sides 7. Base section 4 supports the seat cushion 2 between the two sides 7, and the reclining back 3 extends from the back 6 of the base section 4.

Figure 2A:
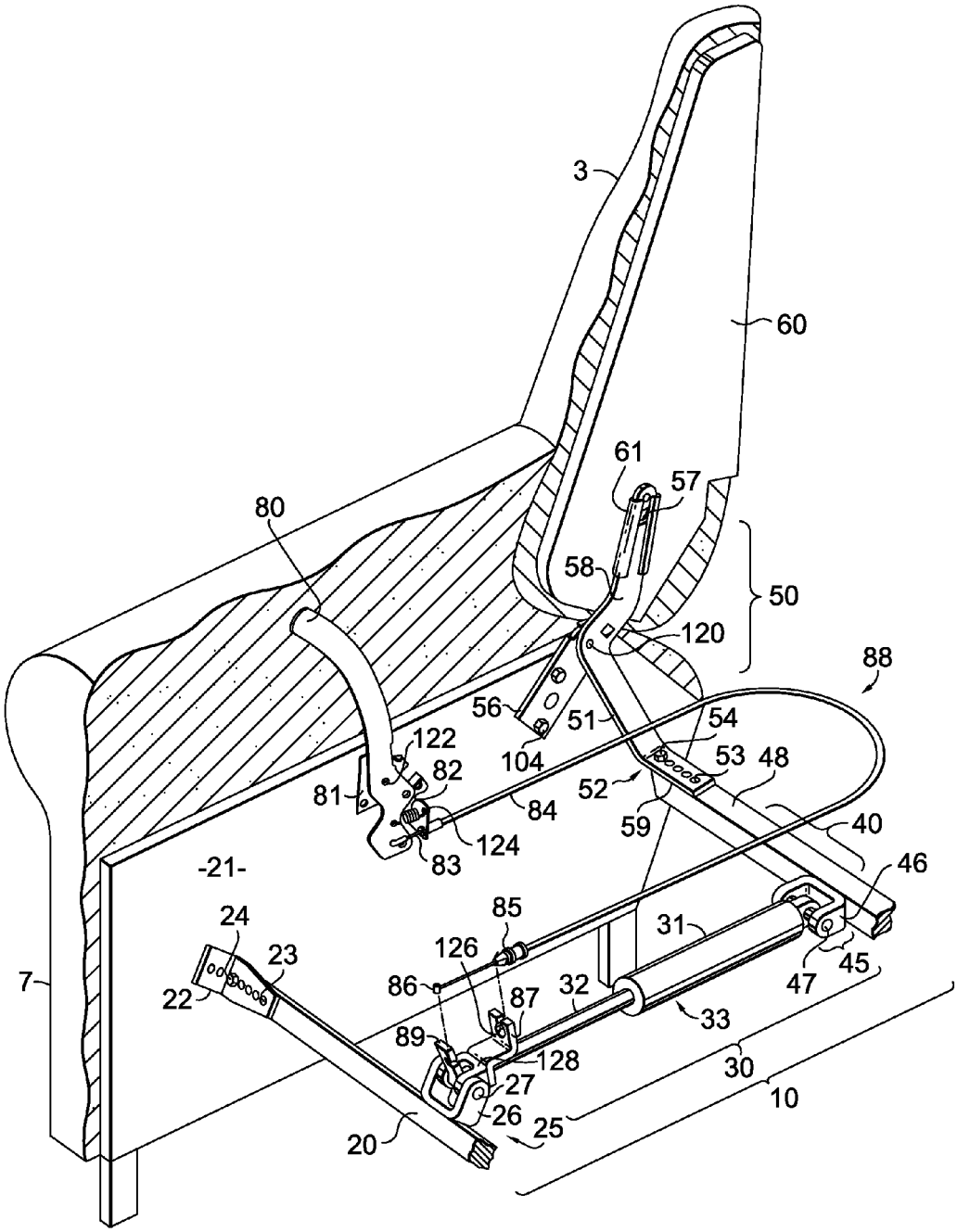
FIG. 2A is a diagrammatic partial perspective view of the reclining back mechanism with a lever control with certain parts being removed or broken-away for clarity.
Figure 2B:
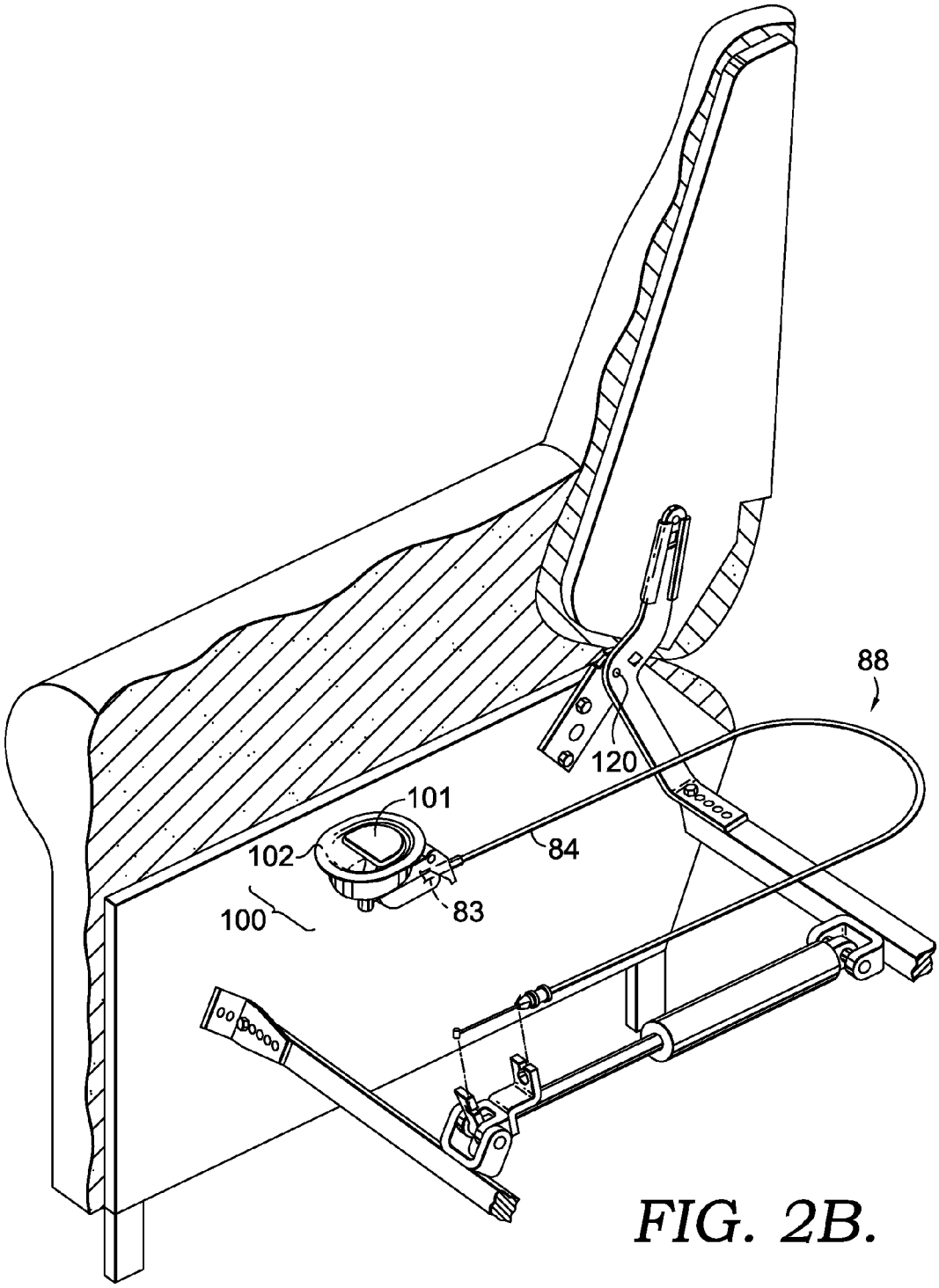
FIG. 2B is a view similar to FIG. 2A, but with a manual cup actuator.
Figure 2C:
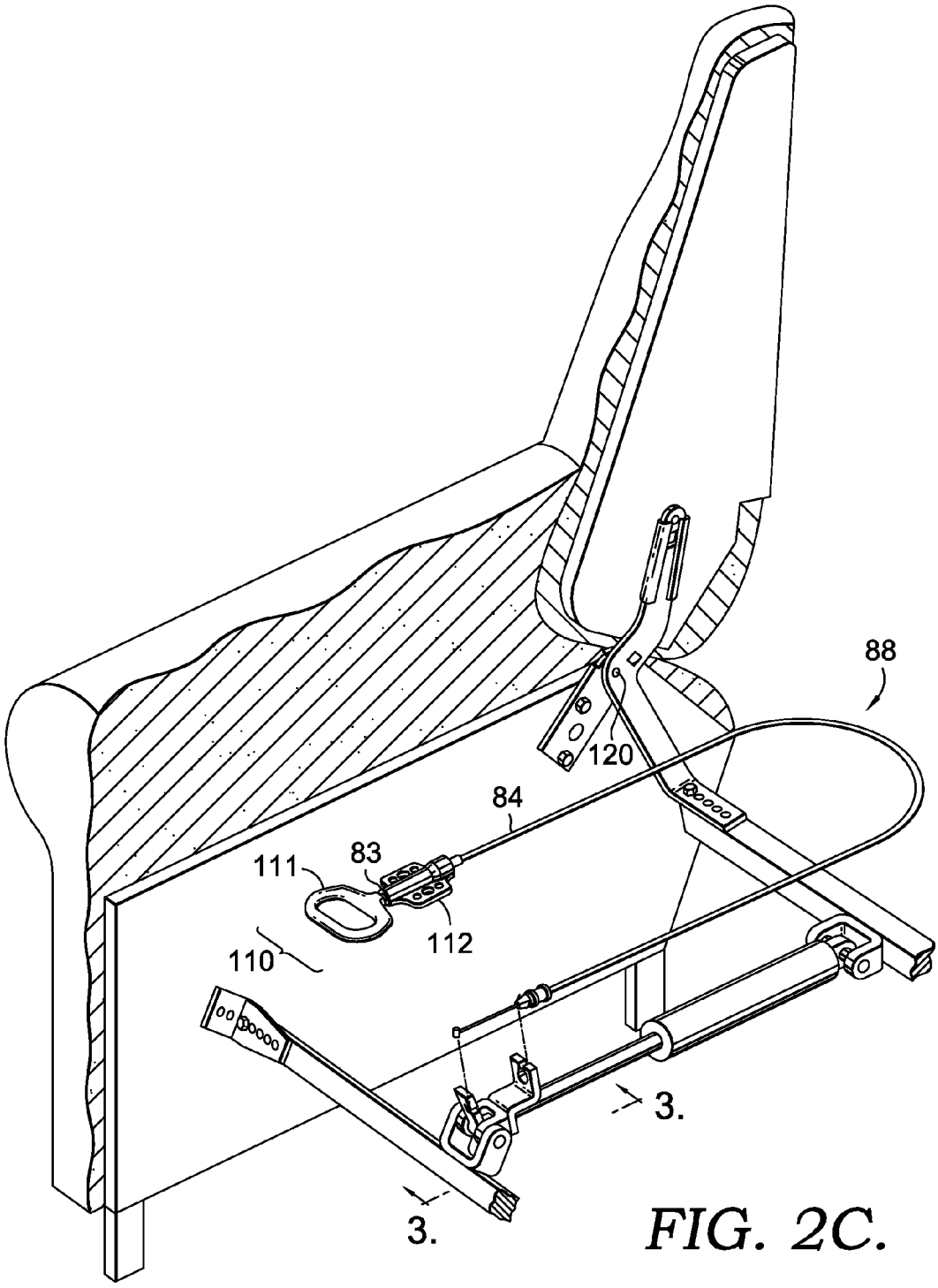
FIG. 2C is a view similar to FIG. 2A, but with a manual D-handle actuator.

As shown in FIGS. 2A-2C, the mechanism 10 for adjusting the inclination of the reclining back 3, as selected by the user, broadly includes a forward transverse member 20, an actuator 30, a rearward transverse member 40, and a pair of arms 50. The mechanism 10 is disposed between two mirror image opposed side frame members 21, which support each of the two sides 7 of the reclining chair 1. As can be seen, and as further described below, aside from the arms 50, the mechanism 10 is disposed beneath the seat cushion 2.

Returning to FIG. 2A, the forward transverse member 20 is made from a generally rigid material, such as square steel tubing or square stock, and generally extends between the opposed side members 21. Member 20 has opposed ends that fixedly connect to a mounting bracket 22. Mounting bracket 22 includes multiple mounting hole locations 23 that allow the forward transverse member 20 to be attached at a selection of positions. This range of positions affects the spacing between the opposed side members 21 and provides for installation of the present mechanism 10 within a variety of base sections having different widths. An exemplary spacing of the mounting hole locations 23 will allow a particular forward transverse member 20 to assemble into a two-inch range of chair widths in one-half-inch increments. The multiple mounting hole locations 23 receive a fastener 24 that fixedly connects the forward transverse member 20 to the mounting bracket 22. One fastener 24 is shown in FIG. 2A, however, multiple fasteners 24 may be used. An exemplary configuration of the forward transverse member 20 connected to the mounting bracket 22 requires two fasteners 24. The connection by fastener 24 may be made by hex-bolts and hex-nuts, or any other suitable fasteners which are well known in the furniture manufacturing industry. The other leg of bracket 22 is connected to the respective side frame member 21.

Figure 3:
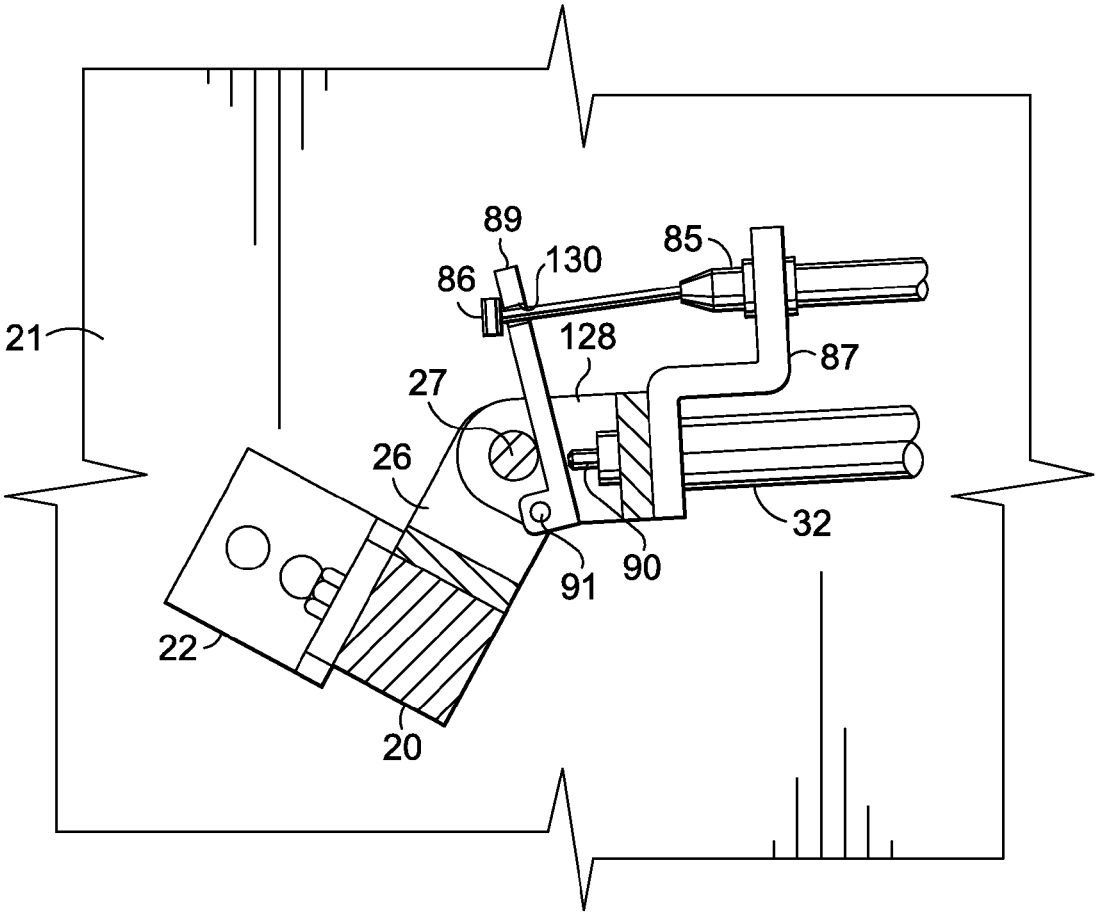
FIG. 3 is an enlarged partial side elevation view of the gas cylinder-release assembly of the actuator.

The actuator 30 extends rearward from the forward transverse member 20 and is pivotably attached between the opposed ends of the forward transverse member 20 by a pivot assembly 25. An exemplary configuration of the pivot assembly is a C-bracket 26 fixedly connected to the forward transverse member 20. The C-bracket 26 receives a pin 27 through opposed holes, wherein the pin 27 is fixedly attached to the C-bracket 26. As shown in FIGS. 2A-2C, the preferred embodiment of the actuator 30 is a gas cylinder 33 that includes a rod end 32 and a head end 31. An exemplary embodiment of the gas cylinder 33 is a compressed gas spring cylinder. Compressed gas spring cylinders will hold in a rigid position whether compressed or extended. This type of gas cylinder 33 will extend upon releasing stored, compressed gas from within the cylinder. It can be seen that the rod end 32 is directed forward toward the front 5 of the base section 4. As best seen in FIG. 3, and as further described below, rod end 32 is coupled to assembly 25, allowing the release of rod end 32 to return reclining back 3 to an upright position.

The head end 31 of the gas cylinder 33 is pivotably connected to the rearward transverse member 40 by a pivot assembly 45. An exemplary configuration of the pivot assembly 45 is a C-bracket 46 fixedly connected to the rearward transverse member 40. The C-bracket 46 receives a pin 47 through opposed holes, wherein the pin 47 is fixedly attached to the C-bracket 46. It can be seen that the head 31 is directed rearward toward the back 6 of the base section 4. A bore through the head end 31 receives the pin 47 that allows the actuator to pivot rotationally about the axis of the pin 47.

The rearward transverse member 40 is made from a generally rigid material, such as square steel tubing or square stock, and generally extends between the opposed side members 21. Member 40 has opposed ends that fixedly connect to the arms 50. The arms 50 have a formed tab 52 that extends from a downward end 51. Formed tab 52 is set at an angle such that a bottom surface 59 of the formed tab 52 is aligned with a mounting surface 48 of the rearward transverse member 40. Formed tab 52 has multiple mounting hole locations 53 that allow the rearward transverse member 40 to be attached at a selection of positions. These multiple mounting hole locations 53 are consistent in number and spacing with the multiple mounting hole locations 23 of the mounting bracket 22. An exemplary spacing of the mounting hole locations 53 will allow a particular rearward transverse member 40 to assemble into a two-inch range of chair widths in one-half-inch increments. The multiple mounting hole locations 53 receive a fastener 54 that fixedly connects the rearward transverse member 40 to the formed tab 52 of the arm 50. One fastener 54 is shown in FIG. 2A, however, multiple fasteners 54 may be used. An exemplary configuration of the rearward transverse member 40 connected to the formed tab 52 requires two fasteners 54. The connection by fastener 54 may be made by hex-bolts and hex-nuts, or any other suitable fasteners which are well known in the furniture manufacturing industry.

The arms 50 have a downward end 51 and an upper end 58. Between the downward end 51 and the upper end 58, the arms 50 are pivotably coupled to the opposed side members 21 by a back pivot bracket 56. The back pivot bracket 56 is fixedly connected to the opposed side members 21 by mounting hardware 104. Additionally, the back pivot bracket 56 is pivotably connected to the arms 50 at pivot point 120 that provides an axis about which reclining back 3 is allowed to rotate. Arms 50 are formed from a sturdy material, such as stamped, formed steel. It should be understood that other suitable materials could also be used.

The upper end of the arms 58 includes one part of a knock-down fastener 57. The knock-down fastener 57 includes a male component that allows the arms 50 to mate with a complimentary female component 61 that is fixedly connected to the opposed side frames 60. The assembly of these components 57, 61 fixedly couples the arms 50 to the opposed side frames 60. The opposed side frames 60 form a part of the reclining back 3, and the arms are attached to the base section 4 at pivot point 120. Therefore, the components 57 and 61 allow for the disassembly of the reclining chair 1 by a two point disengagement. Exemplary configuration of the knock-down fastener 57 are any of the knock-down fasteners known within the art. These knock-down fasteners facilitate the rapid assembly and disassembly of the reclining back 3 from reclining chair 1 and provide for the option of shipping the base section 4 as a separate unit from the reclining back 3.

In use, a user of chair 1 can recline the reclining back 3 by activating a release valve 90 (FIG. 3) provided with actuator 30, and pressing rearwardly on the back. As the user exerts this rearward force, the reclining back 3 pivots about the pivot point 120. This pivoting motion is carried through the downward ends 51 of arms 50. This, in turn, exerts a forward force on member 40 and acts to compress rod 32 of actuator 30. To adjust the reclining back 3 forward, the release valve 90 of actuator 30 is activated allowing its predisposed extension force to return the reclining back 3 to the fully upright position.

The release valve 90 is operated by a release mechanism. As shown in FIG. 2A, one configuration of the release mechanism uses a manually actuated lever 80. Lever 80 has a handle that extends above seat cushion 2 and a mounting section below seat cushion 2. The mounting section is used to pivotably attach lever 80 to side member 21. To achieve this coupling, a pivot bracket 81 is provided. Bracket 81 is fixedly coupled to side member 21, such as by bolts, screws, or other attachment methods. The pivot point of lever 80 to bracket 81 is shown at pivot point 122 in FIG. 2A. Bracket 81 has a section 124 extending perpendicularly to side member 21.

Section 124 serves as a connecting anchor for a spring 82. The opposite end of spring 82 is connected with the mounting section of lever 80 below pivot point 122. Spring 82 serves to return lever 80 to a forward position. Section 124 also serves as a mounting point for one end of a cable 88. Specifically, cable 88 has an external end 83 extending from a conduit 84. The cable is allowed to move axially within the conduit as is known to those of skill in the art. The external end 83 is coupled to the mounting section of lever 80 below the pivot point 122. The end of conduit 84 adjacent section 124 is coupled to section 124, such that the conduit is fixed and cannot move.

A length of cable 88 is provided to extend cable 88 to the release valve 90. Cable 88 may be held in place in a desired location through various attachment mechanisms or grommets. The end of conduit 84 adjacent the release valve 90 has a mounting sleeve 85 sized to accommodate a snap-in attachment to a release mechanism, as further described below. Similarly, the cable 88 has an exposed external end 86 that is provided to apply force against the release lever 89, which in turn transfers force to the release valve 90 when activated by the release mechanism.

Turning to FIG. 3, an enlarged view of the release mechanism at the end of rod 32 is shown. A cable mounting bracket is coupled to the end of rod 32. Bracket 87 has a slot 126 (FIGS. 2A-2C) shaped and sized to facilitate a snap fit with mounting sleeve 85. Bracket 87 is fixedly attached to a yoke 128. Yoke 128 is generally U-shaped with two outwardly extending legs. Each of these legs has a hole to accommodate pin 27. A lever 89 is positioned between the legs of yoke 128 and is pivotably connected between the legs with a pin 91. Each of the legs of yoke 128 has a hole to accommodate pin 91. The lever 89 pivots about pin 91 and is held in place with the external end 86 of cable 88. Yoke 128 is also coupled to a C-bracket 26 through pin 27. Lever 89 is formed with a slot 130, which facilitates connection with cable 88. More specifically, the external exposed end of cable 88 is placed through slot 130, and the end 86 abuts lever 89. As seen in FIG. 3, the release valve 90 is positioned between the legs of yoke 128, and directly behind lever 89.

In use, a user of chair 1 may pull lever 80 to recline or return the reclining back 3 to an upright position. Pulling lever 80 rotates the lever about point 122, which engages end 83 of cable 88 to pull the cable itself through conduit 84. This in turn pulls the end 86 against lever 89, and rotates lever 89 about pin 91. As lever 89 rotates, it contacts release valve 90, releasing rod 32. As the rod 32 is released, the actuator 30 exerts force on member 40 through arms 50 to reclining back 3 to return the back to an upright position.

As shown in FIG. 2B, a second configuration of the release mechanism is shown as a manual cup actuator 100. Similar to the previous configuration, the manual cup actuator 100 operates the release valve 90 whenever a lever 101 is pulled by the user. The lever 101 is connected to the external end 83 of cable 88 and is pivotably connected to the cup 102. The cup 102 is fixedly coupled to the end of conduit 84 adjacent manual cup actuator 100 allowing the cable of cable 88 to pull axially through the conduit 84. The manual cup actuator 100 can be mounted on any surface of the reclining chair 1.

As shown in FIG. 2C, a third configuration of the release mechanism is shown as a manual D-handle actuator 110. The manual D-handle actuator 110 operates the release valve 90 whenever the D-handle 111 is pulled by the user. D-handle 111 is connected to the external end 83 of cable 88. A D-handle bracket 112 is fixedly coupled to the end of conduit 84 adjacent manual D-handle actuator 110 allowing the cable of cable 88 to pull axially through the conduit 84. Similar to the manual cup actuator 100, the manual D-handle actuator 110 can be mounted on any surface of the reclining chair 1.

Although three different configurations of the release mechanism have been shown, it should be understood that other release mechanisms could be used, and that the invention is not limited to those release mechanism shown and described.

Figure 4:
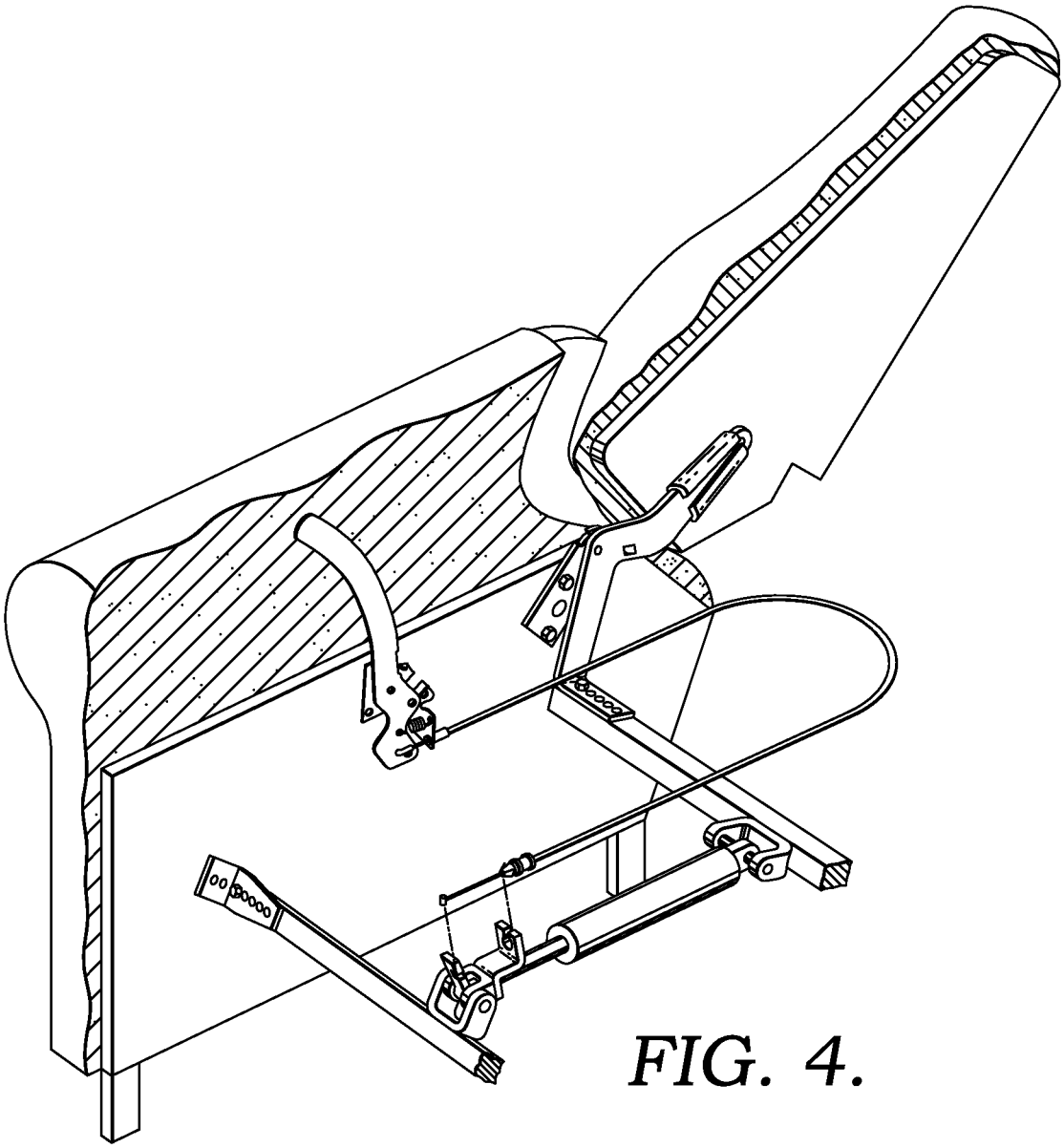
FIG. 4 is a view similar to FIG. 2A with the back reclined.

As previously stated, a component of the actuator 30 is the gas cylinder 33. The gas cylinder 33 biases the reclining back 3 to the upright position as seen in FIGS. 2A-2C. The seat occupant reclines the chair by activating the release valve and exerting force on the reclining back 3. The release valve 90 may be triggered by the user with either configuration of the release mechanism to release the rigid position of the gas cylinder 33. Upon actuating the release mechanism, the external end 83 of cable 88 is pulled outward through the end of the external conduit 84. At the same time, the internal cable end 86 is proportionately pulled toward the mounting sleeve end 85 of conduit 84. This action pivots the release lever 89 about the pin 91 and creates a force on the release valve 90. As the reclining back 3 is biased rearward, the arms 50 pivot about the back pivot bracket 56. Additionally, this action rotates the rearward transverse member 40 toward the forward transverse member 20 thereby compressing the gas cylinder 33. Thus, as force is exerted upon the reclining back 3, the gas cylinder 33 bias must be overcome. When the reclining back 3 is forced into a desirable reclined position, see FIG. 4, the user discontinues actuating the release mechanism such that the release valve 90 deactivates, fixing the gas cylinder 33 in position. Fixing the gas cylinder 33 in position arrests the inclination at a specific rearward bias position.

Then, the release valve 90 may be triggered by the user with either configuration of the release mechanism to return the reclining back 3 to a fully upright bias. The release mechanism triggers the release valve 90 to release pressure from the head end 31 and allows the reclining back 3 to return from the specific rearward bias position to a fully upright bias.

Persons familiar with the field of the invention will realize that it may be practiced by various devices which are different from the specific illustrated embodiment. Therefore, it is emphasized that the invention is not limited only to this embodiment but is embracing of a wide variety of mechanisms which fall within the spirit of the following claims.

What is claimed:

1. A reclining back mechanism for a seating unit, the mechanism coupling a stationary base having a pair of opposed side members, to a reclining back frame having a pair of opposed side frames, the mechanism comprising:

a pair of arms, each arm having an upper end, a lower end, and a middle section extending between the upper end and the lower end, wherein each of said arms is attached at its upper end to a respective one of the opposed side frames, wherein each arm is pivotably coupled at its middle section to a respective one of the opposed side members, and wherein the lower end of one of the arms includes a tab that angles toward an interior space of the stationary base, the tab including a plurality of mounting holes;

a rearward transverse member having opposed ends, wherein the rearward transverse member extends generally between the opposed side members, and wherein one of the opposed ends of the rearward traverse member is coupled to the tab, the plurality of mounting holes enabling the one of the opposed ends to be coupled to the tab at a selection of positions;

an actuator pivotally coupled on one end to said rearward transverse member, said actuator extending out from said rearward transverse member and terminating at an opposing front end; and a forward transverse member having opposed ends, wherein the forward transverse member is coupled to the opposing front end of the actuator and wherein each of the opposed ends of the forward transverse member are rigidly coupled to a respective side member, such that each opposed end of the forward transverse member does not move relative to the respective side member.

2. The mechanism of claim 1, wherein each of the arms is provided with a mating component on the upper end thereof to facilitate a connection with the reclining back frame.

3. The mechanism of claim 2, wherein the mating component is the male part of a knock-down fastener.

4. The mechanism of claim 1, wherein a fastening device with multiple hole mounting locations couples the opposed side members to the opposed ends of the forward transverse member.

5. The mechanism of claim 1, wherein said actuator is a gas cylinder having a remote manual control.

6. The mechanism of claim 5, wherein the actuator has a head end and a rod end, and wherein the rod end is pivotably coupled to the forward transverse member and the head end is pivotably coupled to the rearward transverse member.

7. The mechanism of claim 1, wherein said actuator has a range between a fully extended position and a fully retracted position and wherein said actuator can hold said reclining back frame at any position within the range.

8. A seating unit, comprising:

a base with opposed side members;

a seating support surface extending between the opposed side members;

a reclining mechanism coupled to the base, the reclining mechanism including (1) a pair of arms, each arm being pivotably coupled at a respective middle portion to a mounting plate of a respective one of the opposed side members, (2) a rearward transverse member having opposed ends, each of which is coupled to a respective tab positioned at a bottom end of a respective one of the arms, wherein each tab angles toward an interior space of the base and includes a plurality of mounting holes, (3) forward transverse member rigidly coupled to the side members, such that the forward transverse member does not move relative to the side members, and spaced forwardly of the rearward transverse member, and (4) a biasing member coupled to and between the forward and rearward transverse members; and a reclining back coupled to a top end of each of the arms of the reclining mechanism, such that as the arms pivot relative to the base, the back reclines relative to the base, wherein the biasing member is adapted to return the back from a reclined position to an upright position.

9. The seating unit of claim 8, wherein the rearward and forward transverse members and the biasing member are located below the seating support surface.

10. The seating unit of claim 9, wherein each arm has an upper end configured as a male component of a quick-release connection adapted for mating relationship with a female component of the quick-release connection, wherein the female component is coupled to the back.

11. The seating unit of claim 9, wherein the forward transverse member is coupled to the respective side member using a fastening bracket with multiple spaced mounting locations that allow the reclining mechanism to be attached to bases of varying widths.

12. The seating unit of claim 9, wherein the biasing member is a gas cylinder.

13. The seating unit of claim 12, wherein the gas cylinder has a release valve and wherein the gas cylinder is positioned such that release of the gas cylinder valve returns the back to an upright position.

14. A reclining mechanism for a seating unit, the seating unit having a base with opposed side members, and a back frame with opposed side frames, the reclining mechanism comprising:

a pair of arms, each arm having an upper end, a lower end, and a middle section extending between the upper end and the lower end, wherein the upper end of each arm is attachable to a respective side frame, and wherein the middle section of each arm is pivotably coupled to a respective one of the side members and wherein the lower end of one of the arms includes a tab that angles toward an interior space of the base, the tab including a plurality of mounting holes;

a rearward transverse member extending generally between the side members, said rearward transverse member being coupled at an end of the rearward transverse member to the tab, wherein the plurality of mounting holes enable the end to be coupled to the tab at a selection of positions; and a biasing means for selectively maintaining the back frame of the seating unit in a reclined position as the arms pivot with respect to the base, and for returning the back frame of the seating unit to an upright position upon selection by a user of the chair, wherein the biasing means causes each arm to pivot at a respective middle portion by moving the rearward transverse member relative to a forward transverse member, which is rigidly coupled to the base.

15. The reclining mechanism of claim 14, wherein the rearward transverse member and the biasing means are positionable below a seating support surface of the seating unit.

16. The reclining mechanism of claim 14, wherein the biasing means comprises a gas cylinder pivotally coupled on one end to the rearward transverse, said gas cylinder extending out from said rearward transverse and terminating at an opposing front end of the gas cylinder, and wherein the opposing front end of the gas cylinder is pivotally coupled to the forward transverse member.

17. The reclining mechanism of claim 16, wherein the gas cylinder comprises a release valve at the opposing front end;

wherein the reclining mechanism further comprises an actuating lever for engaging the release valve, said actuating lever comprising a top end, an engaging section, and a bottom end; and wherein said actuating lever is pivotally coupled at the bottom end, coupled to a cable at the top end, and positioned such that the engaging section engages the release valve when the actuating lever is pivoted by pulling on the cable.

* * * * *